United States Patent [19]

Gorzegno et al.

[11] 4,151,813

[45] May 1, 1979

[54] JET PUMP IN NATURAL CIRCULATION FOSSIL FUEL FIRED STEAM GENERATOR

[75] Inventors: Walter P. Gorzegno; Juan-Antonio Garcia-Mallol, both of Morristown, N.J.

[73] Assignee: Foster Wheeler Energy Corporation, Livingston, N.J.

[21] Appl. No.: 890,762

[22] Filed: Mar. 27, 1978

[51] Int. Cl.[2] ..... F22D 7/00; F22D 7/04

[52] U.S. Cl. ..... 122/407

[58] Field of Search ..... 122/406 R, 407

[56] References Cited

U.S. PATENT DOCUMENTS

| | | | |
|---|---|---|---|
| 2,704,534 | 3/1955 | Dalin et al. | 122/407 |
| 3,240,188 | 3/1966 | Brunner | 122/407 |
| 3,575,144 | 4/1971 | Takahashi et al. | 122/407 |

*Primary Examiner*—Kenneth W. Sprague

*Attorney, Agent, or Firm*—Marvin A. Naigur; John E. Wilson; John J. Herguth, Jr.

[57] ABSTRACT

A jet pump is provided in the downcomer of a natural circulation fossil fuel burning vapor generator to enhance circulation in the vaporizer circuits of the vapor generator. A driving fluid pump is adapted to introduce liquid taken from the drum as driving fluid for the jet pump, and the liquid passing through the downcomer acts as driven fluid for the jet pump.

16 Claims, 2 Drawing Figures

FIG. 1
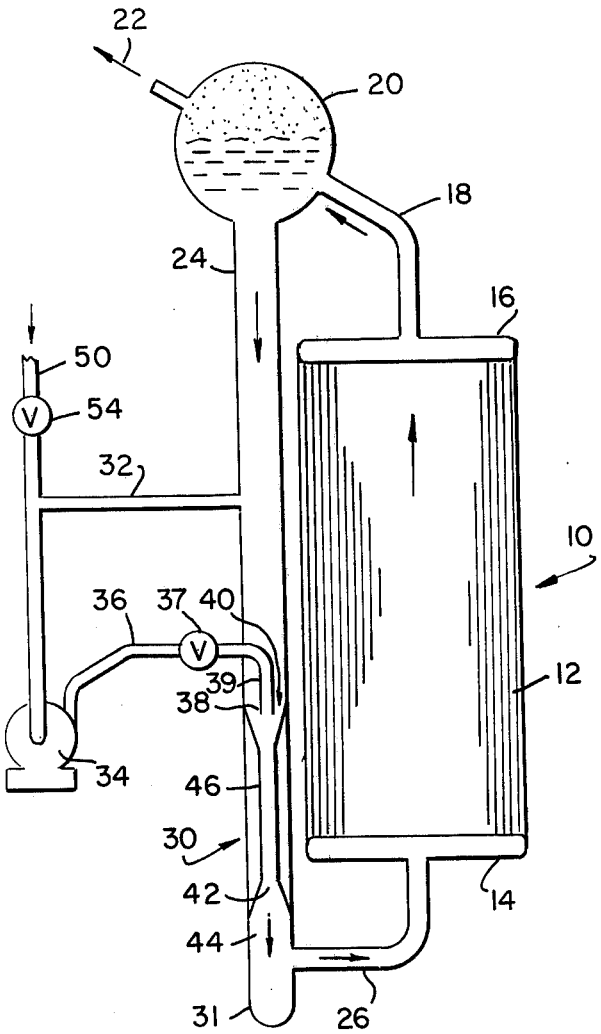
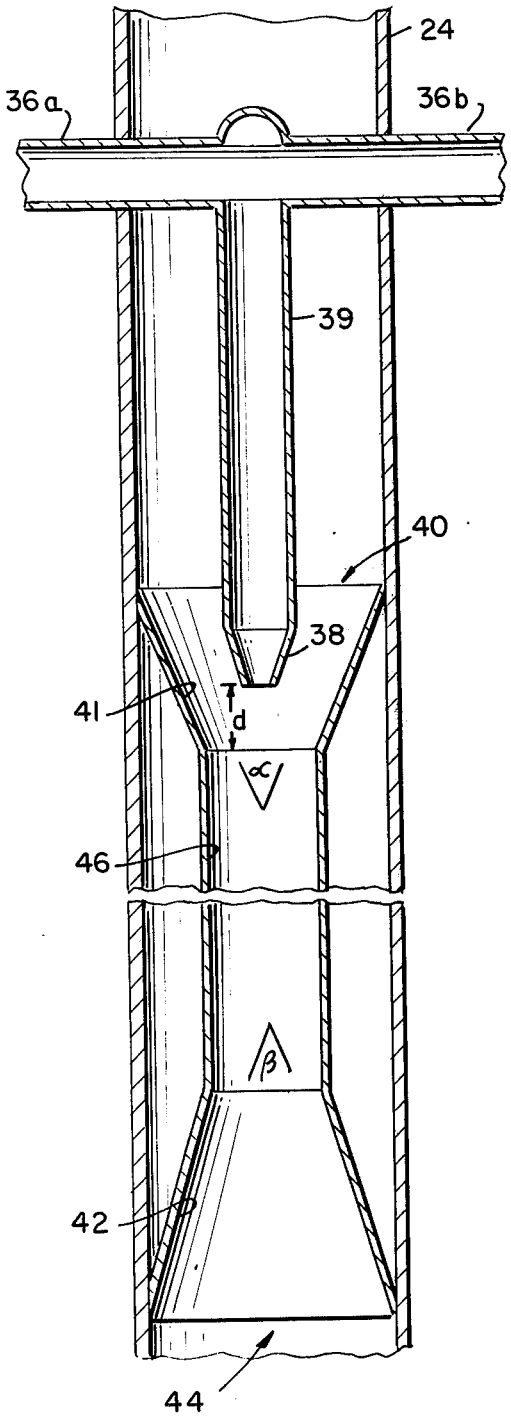
FIG. 2

JET PUMP IN NATURAL CIRCULATION FOSSIL FUEL FIRED STEAM GENERATOR

BACKGROUND OF THE INVENTION

This invention relates to vapor generators, and more particularly, to vapor generators of the natural circulation type.

In a natural circulation vapor generator a vaporizable fluid, such as water, is passed through a group of evaporator tubes, or riser tubes which are disposed within, or are arranged to form, the furnace walls of the vapor generator. A fuel is burned within the furnace, thereby giving off heat which is absorbed by the vaporizable fluid passing through the riser tubes. As the fluid is heated, a vapor-liquid mixture rises through the riser tubes and passes into a separating drum which communicates with the outlet ends of the riser tubes. Saturated vapor is separated from the liquid within the drum, and passed to a superheater inlet or a point of use. Saturated liquid, the liquid phase of the vaporizable fluid passed to the drum, is returned through unheated downcomers to the inlets of the riser tubes. The pumping head in this type of vapor generator is provided by the density difference between the saturated liquid in the unheated downcomers and the vapor-liquid mixture in the heated risers.

One of the many factors to be considered in designing a vapor generator is the type of fuel to be burned. If a fuel different from the one considered during design is used, then the vaporizing circuits of the vapor generator may not function as intended due to a heat absorption pattern different from the pattern for which the unit was designed. In view of present shortages of natural gas and oil, it has become necessary to convert existing vapor generators to allow for burning coal. It is therefore possible that after conversion unfavorable heat patterns may be exhibited.

Change of fuel is only one reason why an unfavorable heat pattern may be experienced, however. Improper design, as well as a change in the mode of operation, going from base load to cycling load, for example, may also contribute to unfavorable heat patterns.

The instant invention is intended to improve the circulation for less than favorable heat absorption patterns of a natural circulation fossil fuel fired vapor generator by providing a water jet pump to enhance the circulation in the vaporizer circuits.

SUMMARY OF THE INVENTION

In a natural circulation fossil fuel burning vapor generator comprising a vapor generating circuit including a plurality of riser tubes, a separating drum, and a downcomer conduit connected between the drum and the inlet ends of the riser tubes, a jet pump is provided which is disposed within the downcomer conduit. The jet pump includes a nozzle section adjacent a suction inlet end thereof, a diffuser section adjacent an outlet end thereof and a throat section intermediate the inlet and outlet ends. A driving fluid pump is adapted to receive a portion of the saturated liquid flow from the drum. Means are provided to pass saturated liquid from the drum to the driving fluid pump. A conduit is connected between the outlet end of the driving fluid pump and the nozzle section of the jet pump, the saturated liquid being pumped to the nozzle section acting as a driving fluid within the jet pump.

An improved method of operating a natural circulation fossil fuel burning vapor generator is also provided. A portion of the saturated liquid in the drum is passed through a driving fluid pump, and thereafter introduced to the nozzle section of a jet pump disposed within the downcomer conduit at a location upstream of the bottle disposed adjacent the outlet end of the downcomer. The remainder of the saturated liquid in the drum is passed through a downcomer conduit, and acts as suction flow fluid passing through the jet pump. The driving fluid and suction fluid are mixed in the throat section of the jet pump, and pass to the diffuser section of the jet pump. In the diffuser section the velocity head of the driving fluid is converted into static pressure head, such that the static pressure of the mixture of driving fluid and suction flow fluid is greater than the static pressure of the suction flow fluid at the jet pump inlet. As a result, the fluid velocity through the riser tubes is increased.

BRIEF DESCRIPTION OF THE DRAWINGS

The above brief description, as well as further objects, features and advantages of the present invention, will be more fully appreciated by reference to the following detailed description of the presently preferred but nonetheless illustrative embodiments in accordance with the present invention when taken in connection with the accompanying drawing, wherein:

FIG. 1 is a schematic view of a natural circulation vapor generating circuit including the instant invention; and FIG. 2 is an enlarged sectional view of an alternative embodiment of the jet pump of the instant invention.

DESCRIPTION OF THE PREFERRED EMBODIMENT

Referring to FIG. 1 of the drawings, a schematic representation of a vapor generating circuit incorporating the instant invention is indicated by reference numeral 10. A plurality of riser tubes 12 define a furnace section in which a fossil fuel is burned. Tubes 12 extend between inlet and outlet headers 14 and 16 respectively. A vaporizable fluid is passed upwardly through tubes 12 coming in indirect heat exchange relation with hot gases in the furnace. It is to be understood that various vaporizable fluids can be used, but for purposes of illustration, this disclosure will discuss the use of water. A conduit 18 is connected between outlet header 16 and drum 20, and is adapted for passing vaporizable fluid from outlet header 16 to drum 20. As a result of the aforementioned heat exchange, the water passing to drum 20 comprises saturated steam and liquid. Within drum 20 saturated seam is separated from saturated liquid, with the steam being removed from the drum 20 through steam outlet 22. The steam can be passed to a point of use, or alternatively routed to other circuits of the vapor generator, such as superheater circuits, not shown, for additional heating. The saturated liquid is removed from drum 20 through downcomer conduit 24 which communicates at one end with drum 20 and distributing bottle 31 at its other end, which in turn communicates with feeder pipe 26. It is to be understood that while only one feeder pipe 26 and one conduit 18 are illustrated a plurality of such pipes and/or conduits can be used.

A jet pump generally indicated by reference numeral 30 is disposed within downcomer conduit 24, upstream of bottle 31 disposed adjacent the outlet end of the downcomer conduit 24. Bottle 31 distributes the fluid through feeder pipes 26 to header 14. The jet pump 30 will be described in more detail hereinafter. A conduit 32 communicates with downcomer conduit 24 at a location upstream of the jet pump 30. Conduit 32 communicates at its other end with a centrifugal pump 34. In some applications it may be desired to have a shutoff valve (not shown) in conduit 32 which could be closed when the jet pump 30 is taken out of service. Jet pump 30 can be taken out of service, or allowed to idle, by taking pump 34 out of service. It is to be understood that while a centrifugal pump is disclosed, other types of pumps can be used in lieu of a centrifugal pump. Pump 34 is adapted to increase the pressure of the inlet fluid introduced to the pump 34 through conduit 32, and furnish this increased pressure drawing fluid through conduit 36 to jet pump nozzle 38. It is to be understood that in the preferred embodiment the driving fuid is taken from a downcomer 24 at a location upstream of the jet pump 30, but the driving fluid can be introduced to pump 34 by other means communicating with drum 20. The means, for example, could be a downcomer other than downcomer 24 and a pipe connected from the other downcomer and pump 34, or could be a pipe connected directly between drum 20 and pump 34. Another conduit 36 communicates at one end with the outlet of centrifugal pump 34 and at its other end with the jet pump 30, such that fluid after having been passed through centrifugal pump 34, and after having experienced an increase in pressure, is passed to the jet pump to act as a driving fluid. A control valve 37 is disposed within conduit 36, and is adapted to control the flow of driving fluid to the nozzle section 38.

In the schematic arrangement of FIG. 1 the jet pump 30 is shown as including a nozzle section 38 adjacent an upper inlet suction end 40, a diffuser section 42 adjacent a lower outlet end 44, and an intermediate throat section 46. Nozzle section 38 is in flow communication with conduit 36 via conduit 39 such that the driving fluid is pumped into jet pump 30 through nozzle section 38. In FIG. 2 an alternative embodiment of jet pump 30 is illustrated. In this embodiment driving fluid is introduced through opposed branches **36*a* and 36*b*, each of which communicates with conduit 36 at their respective inlets. This embodiment is intended to lessen any erosive effect on the conduit communicating with the nozzle section 38 which could result from the rapid change of direction of the flow of driving fluid passing from conduit 36 or branches 36*a*, 36*b* to conduit 39. In jet pump 30 of either embodiment shown in FIG. 1 and/or FIG. 2, that portion of saturated liquid which is removed from the downcomer conduit 24 and passed through conduit 32, pump 34, conduit 36, branches 36*a* and 36*b*, conduit 39 and then into nozzle section 38 acts as a driving fluid for the jet pump. The remainder of the saturated liquid flowing downwardly through downcomer 24 acts as suction flow fluid, entering jet pump 30 at suction inlet end 40 of the jet pump 30. Since the driving fluid has been passed through pump 34 it has a higher pressure, and consequently has a higher momentum than the remainder of the saturated liquid which acts as suction flow fluid. The higher pressure of the driving fluid is converted into higher velocity by nozzle section 38 as the driving fluid passes therethrough. The higher velocity driving flow fluid passes into the throat section 46 and entrains the suction flow fluid. Within the throat section momentum transfer occurs between the driving fluid and suction flow fluid, and the two fluids are mixed, yielding a single stream of fluid which has a velocity intermediate that of the driving fluid and the suction flow fluid. Within the diffuser section 42 the velocity head of the stream of mixed fluids is converted to static pressure. As a result the static pressure of the mixture of driving flow fluid and suction flow fluid downstream of jet pump 30 is greater than the static pressure of the saturated liquid at the jet pump inlet 40**, after allowing correction for gravity and velocity head differences.

In a particular application of the instant invention, the downcomer conduit 24 comprised a pipe having 10¾ inch outside diameter and a 8¼ inch inside diameter. Inlet pipe 39 communicating with nozzle section 38 was made from a section of pipe having a 3½ inch outside diameter and a 3 inch inside diameter. Nozzle section 38 comprised an inverted frustoconical tubular member tapering from a 3 inch inside diameter to a 1½ inch inside diameter with a wall thickness of 0.125 inch at the nozzle outlet. The inside diameter of the jet pump was 8¼ inches adjacent the suction inlet end thereof and tapered to a 4 inch inside diameter at the location of the throat section 46 inside. A second inverted frustoconical tubular member 41 concentric with nozzle section 38 is utilized to accomplish the reduction in jet pump inside diameter, and together with the nozzle section 38 defines an annular passageway upstream of the inlet to throat section 46. The included angle $\alpha$ of the member 41 is approximately 30 degrees. Throat section 46 comprised a 2 foot 6¼ inch long section of pipe having a 5½ inch outside diameter and a 4 inch inside diameter. The outlet tip of nozzle section 38 is disposed a distance d equal to 4½ inches upstream of the throat section 46 inlet. Inlet branches **36*a*, 36*b* were made from pipe having a 3½ inch outside diameter and 2½ inch inside diameter. Diffuser section 42** is defined by a frustoconical tubular member having an included angle $\beta$ of 8 degrees and a wall thickness of 0.5 inch. A jet pump of half the size of that described above was tested, and exhibited a maximum efficiency of 45%, which corresponds to a ratio of entrained fluid flow to driving fluid flow of 2.2.

Returning to FIG. 1, a conduit 50 is shown which communicates at one end with conduit 32. Conduit 50 communicates at its other end with another component of the vapor generator through which water at a pressure higher than the pressure of the fluid in downcomer 24 is passed. It is contemplated that conduit 50 can be connected to various components such as feedwater heaters, or economizers in order to achieve the result intended. A shut off valve 54 is disposed in conduit 50, which, when in a closed position, will prevent passage of fluid from the other component, i.e., the economizer, feedwater heater, etc., to conduit 32. The water taken from the other component and passed through conduit 50 should have a lower temperature than that of the fluid removed from downcomer conduit 24. While in FIG. 1 it shows the introduction of fluid from conduit 50 to a point upstream of centrifugal pump 34, it should further be understood that this fluid can be introduced downstream of pump 34, if the pressure of the respective fluids allow. The fluid passing through conduit 50 is routed to nozzle section 38 of jet pump 30, in order to reduce the temperature of the driving fluid to a level below saturation temperature, so as to avoid flashing of jet pump fluid into steam, which could occur for example in the throat section of the jet pump. The arrangement of FIG. 1 is preferred because by introducing fluid through conduit 50 from another component at a location upstream of a centrifugal pump 34, one can also protect against cavitation which could occur in the inlet end of centrifugal pump 34, since the enthalpy of the stream of mixed fluids entering the inlet of centrifugal pump 34 would be lower than the enthalpy of the fluid removed from downcomer conduit 24.

In operation a vaporizable fluid such as water passes through a preheating circuit, such as a feedwater heater or an economizer, and thereafter a drum 20. Liquid flows through downcomer conduit 24 and is passed through feeder pipe 26 to inlet header 14 of vapor generating circuit 10 of the natural circulation vapor generator. The water rises through riser tubes 12 lining the furnace section of the vapor generator and picks up heat which is applied to riser tubes 12 by burning a fossil fuel such as coal within the furnace section. The water is heated as it passes through riser tubes 12, passed into outlet header 16, and thereafter passed back to drum 20 via conduit 18. Some of the fluid passed through conduit 18 is saturated steam and some is saturated liquid. Within drum 20 the saturated steam is separated from the liquid, and is removed from the drum through steam oulet 22. Saturated liquid is returned to inlet header 14 through downcomer conduit 24, distributing bottle 31 and feeder pipe 26. A portion of the saturated liquid being returned through downcomer circuit 24 is extracted from the downcomer conduit and passed through conduit 32. That portion of the saturated liquid passing through conduit 32 is routed via centrifugal pump 34 and conduit 36 to the nozzle section 38 of jet pump 30. Vaporizable fluid of a lower temperature than that in conduit 32 can be taken from a location upstream of the vapor generating circuit, such as from the economizer inlet and introduced through conduit 50 with valve 54 opened in order to reduce the enthalpy of the driving fluid. The driving fluid in the jet pump nozzle 38 has a velocity and momentum greater than that of the remainder of the saturated liquid flowing through the downcomer conduit 24. The remainder of the saturated liquid flow through downcomer conduit 24 enters jet pump 30 through suction inlet end 40, passes through an annular passageway within jet pump 30 around nozzle 38, and into throat section 46. The driving fluid and driven fluid, also referred to as entrained fluid, mix in the throat section 46, and together yield a stream of mixed fluid having a velocity and momentum greater than that of the saturated liquid passing through downcomer conduit 24. The mixed stream is then passed through diffuser section 42, in which the velocity head of the stream of mixed fluid is converted into static pressure. The stream of fluid emerging from the outlet end of the jet pump 30 has a static pressure which is greater than the static pressure of the saturated liquid flowing through the downcomer conduit at the jet pump inlet, after correction is made for gravity and velocity head differences.

Since the jet pump 30 is disposed within the downcomer 24 upstream of bottle 31, only minimum alternation of an existing vapor generator is required in order to practice the instant invention. In this regard the instant invention offers a significant advance over known natural circulation vapor generator designs incorporating jet pumps at other locations within the circuitry, since retrofit of known designs would likely require considerably more alteration of the vapor generator, and hence would require more expense. Furthermore, the jet pump of the instant invention could be removed from service at different times during operation if the absorption pattern of a particular vapor generator allows, since the pressure drop through the jet pump can be relatively small while it is idling.

A latitude of modification, change and substitution is intended in the foregoing disclosure, and in some instances some features of the invention will be employed without corresponding use of other features. Accordingly, it is appropriate that the appended claims be construed broadly and in a manner consistent with the scope of the invention herein.

What is claimed is:

1. In a natural circulation fossil fuel burning vapor generator including a vapor generating circuit, said vapor generating circuit including a plurality of riser tubes arranged for passing a vaporizable fluid therethrough in heat exchange relation with hot gases, a separating drum in flow communication with outlet ends of said riser tubes for receiving said vaporizable fluid including saturated vapor and liquid, a downcomer conduit communicating with said drum and arranged to receive saturated liquid from said drum, a distributing bottle connected between the outlet end of said downcomer conduit and the inlet ends of said riser tubes, the improvement comprising:

(a) a jet pump including a nozzle section adjacent a suction inlet end thereof, a diffuser section adjacent an outlet end thereof, and a throat section intermediate said inlet and outlet ends, said jet pump being disposed within said downcomer conduit upstream of the outlet end of said downcomer, saturated liquid flowing through said downcomer conduit acting as suction flow fluid passing into said jet pump through said suction inlet end thereof;

(b) a driving fluid pump adapted to receive a portion of said saturated liquid from said separating drum;

(c) means for passing said portion of said saturated liquid from said separating drum to an inlet of said driving fluid pump; and (d) conduit means connected between an outlet of said driving fluid pump and said nozzle section of said jet pump for introducing said portion of saturated liquid to said nozzle section.

2. The improvement of claim 1 further comprising means for introducing vaporizable fluid of a lower temperature than the temperature of said saturated liquid passed through said downcomer conduit to said jet pump nozzle section.

3. The improvement of claim 2 wherein said means for introducing vaporizable fluid of a lower temperature comprises conduit means adapted to pass said fluid to said jet pump nozzle section from a location upstream of said vapor generating circuit.

4. The improvement of claim 3 in which said vapor generator further includes an economizer circuit and wherein said conduit adapted to pass fluid of a lower temperature is connected between said economizer circuit inlet and said driving fluid pump inlet, said fluid of a lower temperature mixing with said portion of saturated liquid and forming a stream of mixed fluids having a temperature lower than the temperature of said portion of saturated liquid.

5. The improvement of claim 1 in which said means for passing a portion of said saturated liquid from said drum to the inlet end of said driving fluid pump comprises a section of said downcomer conduit communicating at one end with said drum and a conduit connected between said downcomer conduit section and said driving fluid pump, said last-named conduit being arranged to receive said portion of said saturated liquid from said downcomer section at a location along the length of said downcomer conduit upstream of the location of said jet pump.

6. The improvement of claim 5 further comprising means for passing additional vaporizable fluid of a lower temperature than the temperature of said saturated liquid to said jet pump nozzle section whereby the temperature of said driving fluid is reduced such that flashing of said vaporizable fluid within said jet pump is prevented.

7. The improvement of claim 1 wherein said means for passing a portion of said saturated liquid from said drum to said driving fluid pump comprises an additional downcomer and a conduit connected between said additional downcomer and said driving fluid pump inlet.

8. The improvement of claim 7 further comprising a shut-off valve disposed in said means for passing a portion of saturated liquid from said drum to said driving fluid pump.

9. The improvement of claim 1 wherein said conduit means comprises a first conduit communicating at one end thereof with the outlet of said driving fluid pump and communicating at the other end thereof with a plurality of second conduits arranged for parallel flow of fluid therethrough, said plurality of second conduits communicating in turn with the inlet to said nozzle section of said jet pump.

10. The improvement of claim 1 further comprising a control valve disposed upstream of said nozzle section of said jet pump for controlling the flow of driving fluid to said nozzle section.

11. In a method of operating a natural circulation vapor generator including the steps of passing a vaporizable fluid through a plurality of riser tubes in indirect heat exchange with heated gases for heating said fluid, passing said heated fluid including saturated vapor and liquid to a separating drum for separating saturated vapor from said fluid, passing saturated liquid from said drum through a downcomer conduit to a bottle disposed adjacent the end thereof, and passing said fluid from said bottle to said riser tubes, the improvement comprising the steps of:

(a) passing a portion of said saturated liquid from said separating drum to a driving fluid pump;

(b) pumping said portion of saturated liquid through said driving fluid pump thereby increasing the pressure of said portion of saturated liquid;

(c) introducing said portion of saturated liquid of increased pressure into a jet pump, said jet pump being disposed within said downcomer conduit at a location upstream of the outlet end of said downcomer conduit and including a nozzle section adjacent a suction inlet end thereof, a diffuser section adjacent an outlet end thereof, and a throat section intermediate said inlet and outlet ends, said portion of saturated liquid being introduced to said jet pump through said nozzle section of said jet pump and comprising a driving flow fluid;

(d) passing said saturated liquid flowing through said downcomer conduit into said suction inlet end of said jet pump, said saturated liquid comprising suction flow fluid;

(e) mixing said driving flow fluid with said suction flow fluid in said throat section of said jet pump;

(f) passing said fluid mixture to said diffuser section wherein the velocity head of said driving fluid is converted in said diffuser section into static pressure head, said static pressure of said fluid mixture being greater than the static pressure of said suction flow fluid at the location adjacent said jet pump inlet end; and (g) passing said fluid mixture to said bottle for distribution of said mixed fluid of greater static pressure to said riser tubes.

12. The method of claim 11 further comprising the step of passing additional vaporizable fluid from a location upstream of said vapor generating circuit to said nozzle section of said jet pump, said additional vaporizable fluid being of a lower temperature than said saturated liquid flowing through said downcomer conduit upstream of said jet pump.

13. The method of claim 11 wherein said step of passing a portion of said saturated liquid from said separating drum to said driving fluid pump comprising removing a portion of said saturated liquid passing through said downcomer conduit from said drum and thereafter passing said removed portion to said driving fluid pump.

14. The method of claim 13 further comprising the step of passing additional vaporizable fluid of a temperature lower than the temperature of said saturated liquid to said nozzle section of said jet pump, said additional fluid mixing with said removed portion of saturated liquid whereby the enthalpy of said mixture is reduced to a level such that liquid in said jet pump will not flash into vapor.

15. The method of claim 14 wherein said vapor generator further comprises an economizer circuit, said additional vaporizable fluid being passed from the inlet of said economizer circuit to the inlet of said driving fluid pump, said additional vaporizable fluid and said removed portion of saturated liquid together acting as driving fluid thereafter being passed to said nozzle section of said jet pump.

16. The method of claim 12 wherein said vapor generator includes an additional downcomer conduit connected between said separating drum and said inlet ends of said riser tube, saturated liquid passing through said additional downcomer conduit, and wherein said step of passing a portion of said saturated liquid from said drum to said driving fluid pump comprises removing a portion of said saturated liquid passing through said additional downcomer conduit and passing said removed portion to said driving fluid pump.

* * * * *